US011460225B2

(12) United States Patent
Dowdy, III

(10) Patent No.: US 11,460,225 B2
(45) Date of Patent: Oct. 4, 2022

(54) POWER SAVING APPARATUSES FOR REFRIGERATION

(71) Applicant: Jack D. Dowdy, III, Croydon, UT (US)

(72) Inventor: Jack D. Dowdy, III, Croydon, UT (US)

( * ) Notice: Subject to any disclaimer, the term of this patent is extended or adjusted under 35 U.S.C. 154(b) by 228 days.

(21) Appl. No.: 17/008,343

(22) Filed: Aug. 31, 2020

(65) Prior Publication Data

US 2020/0400353 A1 Dec. 24, 2020

Related U.S. Application Data

(63) Continuation-in-part of application No. 16/016,380, filed on Jun. 22, 2018, now abandoned.

(60) Provisional application No. 62/604,125, filed on Jun. 23, 2017.

(51) Int. Cl.
*F25B 11/00* (2006.01)
*F25B 27/00* (2006.01)
*F25B 43/00* (2006.01)

(52) U.S. Cl.
CPC ..... *F25B 11/00* (2013.01); *F25B 27/00* (2013.01); *F25B 43/006* (2013.01); *F25B 2400/051* (2013.01); *F25B 2400/14* (2013.01)

(58) Field of Classification Search
CPC ..... F25B 43/006; F25B 2400/051; F25B 2400/054; F25B 2400/14; F25B 2400/141; F25B 2400/15
See application file for complete search history.

(56) References Cited

U.S. PATENT DOCUMENTS 2,505,393 A * 4/1950 Garner ..... F25B 43/00 165/142
2,966,043 A * 12/1960 Ross ..... F25B 43/006 62/203
3,177,680 A * 4/1965 Rasovich ..... F25B 40/00 62/503
3,872,687 A * 3/1975 Bottum ..... F25B 40/00 62/503
4,318,277 A * 3/1982 Cann ..... F25B 47/022 62/278
4,653,282 A * 3/1987 Gueneau ..... F25B 43/006 62/503
5,007,247 A * 4/1991 Danig ..... F25B 43/006 62/174

(Continued)

*Primary Examiner* — Christopher R Zerphey
(74) *Attorney, Agent, or Firm* — Miller IP Law, LLC

(57) ABSTRACT

A system is described herein for repurposing waste heat from a refrigeration cycle to improve the efficiency of the cycle and power electronic devices. The system may include a compressor, a turbine, an accumulator, a condenser, a throttle, and an evaporator. The accumulator may include a high-pressure chamber connected between the turbine and condenser, and a low-pressure chamber connected between the evaporator and the compressor. The high-pressure chamber may be segregated from the low-pressure chamber such that high-pressure refrigerant in the high-pressure chamber is prevented from mixing with low-pressure refrigerant in the low-pressure chamber. The high-pressure chamber and low-pressure chamber may be thermally coupled such that liquid refrigerant in the low-pressure chamber is vaporized by heat exchange with the high-pressure chamber. The turbine may power an electronic component of the refrigerator or may feed electricity back into a community grid power system.

20 Claims, 10 Drawing Sheets

(56) References Cited

U.S. PATENT DOCUMENTS

| | | | | |
|---|---|---|---|---|
| 5,377,501 | A * | 1/1995 | Muston | F25B 43/02 62/472 |
| 6,185,956 | B1 | 2/2001 | Brasz | |
| 6,526,765 | B2 * | 3/2003 | Lifson | F25B 31/004 62/468 |
| 6,637,227 | B2 * | 10/2003 | Stensrud | F25B 41/22 62/352 |
| 6,962,056 | B2 | 11/2005 | Brasz et al. | |
| 7,404,299 | B2 * | 7/2008 | Drysdale | F01D 15/005 62/228.1 |
| 7,523,621 | B2 * | 4/2009 | Johansson | F25B 27/02 60/653 |
| 8,549,876 | B2 * | 10/2013 | Kaart | F25J 1/0216 62/611 |
| 9,464,831 | B2 * | 10/2016 | Lemee | F28D 7/04 |
| 9,689,599 | B2 * | 6/2017 | Hollingworth | F25B 29/003 |
| 10,845,106 | B2 * | 11/2020 | McKim | F25B 43/006 |
| 2007/0144195 | A1 | 6/2007 | Mahl | |
| 2008/0289335 | A1 * | 11/2008 | Drysdale | H02M 7/10 60/649 |
| 2009/0165456 | A1 * | 7/2009 | Masada | F02C 6/18 60/670 |
| 2010/0031677 | A1 * | 2/2010 | Lifson | F25B 9/06 62/113 |
| 2015/0084346 | A1 * | 3/2015 | Tomigashi | F01K 13/02 290/40 R |
| 2016/0197534 | A1 * | 7/2016 | Walker | F25B 11/02 290/52 |
| 2017/0373561 | A1 * | 12/2017 | Hollingworth | F01K 7/00 |
| 2018/0120009 | A1 | 5/2018 | Hershgal | |
| 2018/0340713 | A1 | 11/2018 | Dowdy, III | |

* cited by examiner 700 cont'd

POWER SAVING APPARATUSES FOR REFRIGERATION

CROSS-REFERENCE TO RELATED APPLICATIONS

The present application is a continuation-in-part of U.S. Non-Provisional patent application Ser. No. 16/016,380 entitled "Power Saver Apparatus for Refrigeration", filed on Jun. 22, 2018, and which claims priority to U.S. Provisional Patent Application No. 62/604,125 filed on Jun. 23, 2017. The entire contents of the above-listed applications are hereby incorporated by reference for all purposes.

BACKGROUND OF THE INVENTION

Most household and industrial refrigerators work by continuously repeating a vapor compression cycle in closed and sealed fluid flow circuit, which comprises a gas compressor, a hot side vapor condenser coil, an expansion valve or a capillary coil or other throttling device and a cold side liquid evaporator coil, using Freon or other coolant or refrigerant liquid, while the compressor is powered by electricity from the grid which supplies 120-460V AC, whereas said hot and cold sides are separated by heat insulation and the cold side is in the space to be cooled and the hot side is outside of it, so the refrigerator transports heat from inside out.

The cold space in a household refrigerator is a heat insulated food storage cabinet, often split to deep freezer and regular freezer compartments, while these two spaces may be separated by doors lids or drawers. The evaporator coil or radiator may also be split accordingly. The throttling device typically receives plus 90-45° C., 8 bar liquid and passes −20° C., 0.6 bar vapor as gas. Depending on the cooled state of the food stored in the cold compartments, the compressor typically receives −20° C. 0.6 bar vapor at low speed and passes plus 90° C., 8 bar vapor as gas at high speed. The kinetic energy of the compressor's discharge gas is not utilized.

SUMMARY OF THE INVENTION

The above problems and others may at least partially solved and the above objects and others realized in a process, using a power saving apparatus in the vapor compression cycle, inserted in the pipeline connecting the compressor and the condenser.

In one embodiment, the apparatus comprises a) A sealed impact micro-turbine, b) A permanent magnet alternator (PMA) generating low voltage direct current (DC), c) An inverter converting the DC to high voltage alternating current (AC), and d) An electrical power-out connector suitable to plug into common grid power receptacle.

In another embodiment, the apparatus comprises a) A sealed impact micro-turbine, b) A permanent magnet alternator (PMA) generating direct low voltage direct current (DC), c) An inverter converting the DC to high voltage alternating current (AC), d) An electrical power-out connector suitable to plug into common AC grid power receptacle, e) A vapor bypass line branched off using an electronically controlled electrical three-way-valve, f) A servo-valve actuator, g) A servo-valve electronic controller, and h) An electrical power-out connector suitable to plug into common DC power receptacle In both configurations, the AC power may be switched, on-and-off manually or controlled electronically and the servo-valve may be substituted by manual valve.

The micro-turbine reduces flow rate and temperature of the hot vapor. The more resistance it has against the vapor flow, the longer the refrigeration cycle is extended by more time needed to cool the food in the refrigerator. Cooling time however seldom considered. The overall refrigeration efficiency may increase by 32% and the vapor cycle efficiency by 13%.

To compare refrigeration technologies, the Coefficient of Performance (CoP) indicator may be used. The energy balance may be expressed as $P_{INPUT}+Q_{ABSORBED}=Q_{REJECTED}$, where $P_{INPUT}$ the supplied electrical power, $Q_{ABSORBED}$ is the heat absorbed from the food in the refrigerator via the evaporator, inside the heat insulated space, and $Q_{REJECTED}$ is the heat added to the room around the refrigerator via the condenser, outside the heat insulated space.

For a conventional refrigerator, $CoP=Q_{ABSORBED}/P_{INPUT}$. For the modified refrigerator as per the teachings described herein, $CoP_M=Q_{ABSORBED}/(P_{INPUT}-P_{OUTPUT})$, where $P_{OUTPUT}$ is the electrical power generated by the PMA. Since $P_{OUTPUT}$ is always higher than zero, even at marginal power generation, $CoP_M>CoP$.

BRIEF DESCRIPTION OF DRAWINGS

The present description will be understood more fully when viewed in conjunction with the accompanying drawings of various examples of power saver apparatuses for refrigeration. The description is not meant to limit the power saver apparatuses for refrigeration to the specific examples. Rather, the specific examples depicted and described are provided for explanation and understanding of power saver apparatuses. Throughout the description the drawings may be referred to as drawings, figures, and/or FIGs.

DETAILED DESCRIPTION

It is proposed that a closed and sealed impact turbine be inserted in the pipeline connecting the compressor and the condenser, while the turbine would drive a permanent magnet alternator or generator (PMA/PMG), generating 12-48V low voltage DC, which passing through an inverter would be plugged in to the wall socket, next to the socket used to take AC power to run the compressor. After some heat and electrical losses, the overall efficiency of the refrigeration improves considerably, alas at the expense of a slight lengthening of the refrigeration time. Should rapid initial refrigeration be required for warm food cooling, the turbine may be bypassed temporarily, controlled by thermostat or other electronic controller, which would actuate the bypass valve.

Power saver apparatuses for refrigeration as disclosed herein will become better understood through a review of the following detailed description in conjunction with the figures. The detailed description and figures provide merely examples of the various embodiments of power saver apparatuses for refrigeration. Many variations are contemplated for different applications and design considerations; however, for the sake of brevity and clarity, all the contemplated variations may not be individually described in the following detailed description. Those skilled in the art will understand how the disclosed examples may be varied, modified, and altered and not depart in substance from the scope of the examples described herein.

Figure 1:
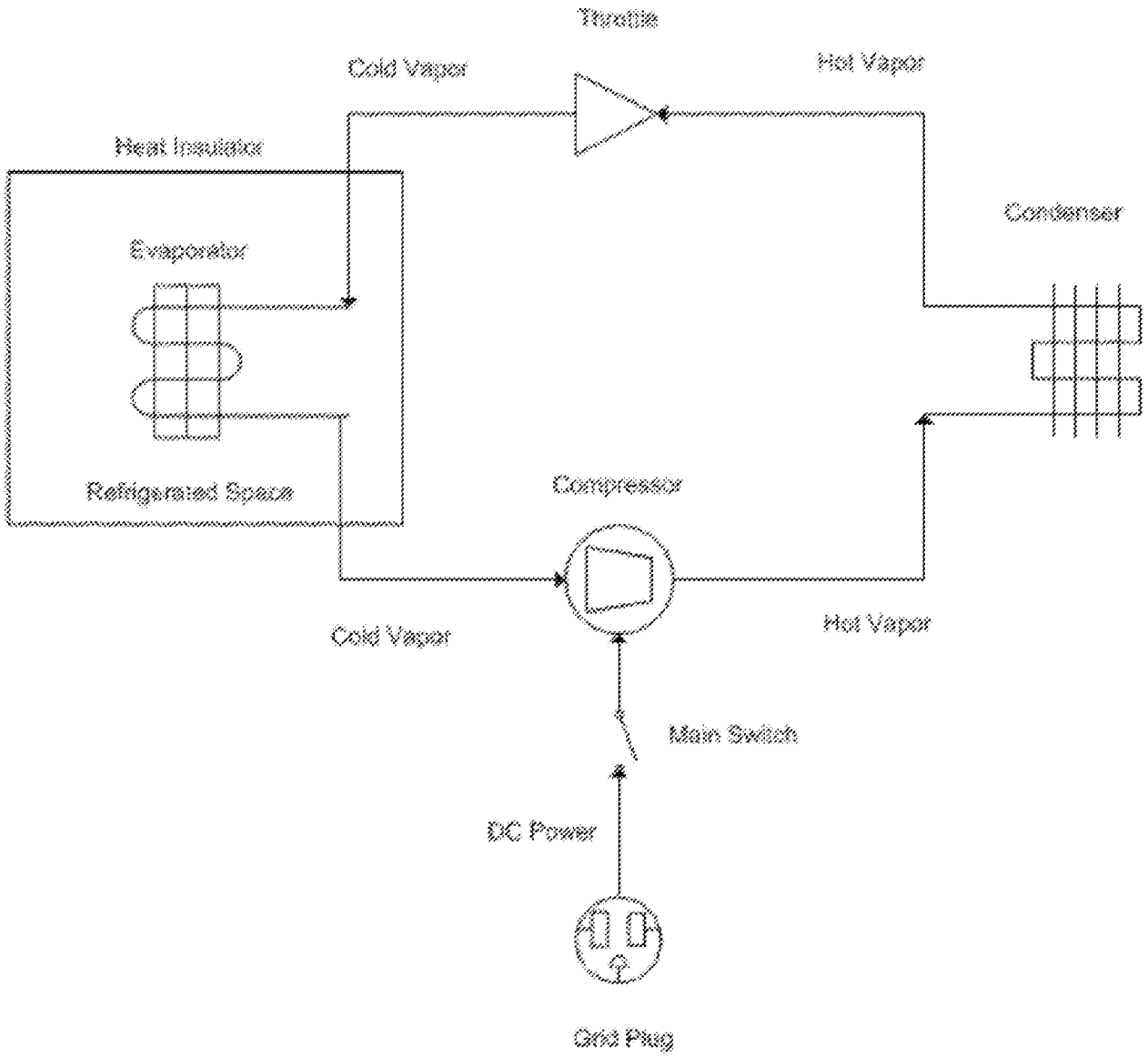
FIG. 1 illustrates a diagram of a conventional vapor compression cycle refrigeration system, according to an embodiment.

Attention is now turned to FIG. 1, which is a diagram illustrating a single-stage STATE-OF-ART vapor compression cycle refrigeration system with components and flow attributes labeled.

The coolant may be selected to suit the application and the environment. For household refrigerator, due to environmental considerations and regulations thereof, the classical Chemorous/DuPont made/owned Freon group of R-12, R-13B1, R-22, R-502 and R-503 (CFC group) may be replaced by the HFC group of R-410A, R-404A, R-406A, R-407A, R-407C, R-408A, R-409A, R-410A, R-438A, R-500 and R-502. For other applications, ammonia, hydrochlorofluorocarbons (HCFCs), sulfur dioxide, methyl chloride and other liquids or ethylene, propane, nitrogen, helium, or other gases may be used. A synthetic oil may be added to lubricate the compressor.

The refrigeration capacity may be defined in "tons of refrigeration" ($T_R$). 1 $T_R$ may be the rate of heat removal required to freeze a short ton (2,000-lbs) of 32° F. (0° C.) water. Since the rate of fusion for water is 144 Btu/lbs, 1 $T_R$=12,000 Btu/h=3.517 kW. A household food and beverage refrigerators may be in the 1-5 tons (3.5-18 kW) region. Other applications may include commercial refrigeration, industrial refrigeration, food processing refrigeration, refrigeration of goods in transport, cooling for electronics, medical refrigeration, and/or cryogenic refrigeration.

The circulating refrigerant may transport heat from the heat insulated closed Refrigerated Space to outside of it. The coolant, in liquid-with-vapor phase, may be relatively cold (i.e. when compared with the ambient environment and/or the contents of the refrigerated space) after passing the Throttle and before entering the Compressor. The compressor may be powered by grid AC from the Grid Plug across the Main Switch. The main switch which may interrupt the AC current flowing to the electrical motor of the Compressor. The coolant may be relatively hot after passing the Compressor and before entering into the Throttle (i.e. hotter than before passing through the compressor). The heat rejection in the Condenser may be at a relatively high temperature (i.e. relative to the ambient environment surrounding the condenser). The heat rejection may be approximately constant. The heat absorption in the Evaporator may be at a relatively low temperature (i.e. relative to the temperature in the refrigerated space and/or the ambient environment surrounding the refrigerator). The vapor may be saturated before entering the compressor. The vapor may be superheated after leaving the Compressor. The vapor may enter and/or leave the Throttle saturated while undergoing adiabatic sudden expansion, which may lower the vapor temperature. The vapor may absorb heat from the of the refrigerated space via the Evaporator. The vapor may reject heat via the Condenser. The Condenser and/or the Evaporator may be radiator-type flat pipe-snakes, panels, and/or coils.

The cold half loop may be at approximately −20° C. temperature and/or approximately 0.6 bar pressure. The hot half loop may be in a range from 90° C. to 45° C. temperature at approximately 8 bar pressure. At a steady state flow Condenser heat transfer rate, the after-Compressor temperature may be approximately conserved up to the Throttle entry point. That may be achieved with convection heat transfer, i.e. by chimney effect when air is stagnant around the refrigerator.

A fan may be added to increase the airflow of the evaporator and water may be used as heat exchanging fluid for the condenser. To reduce cost and complexity, household refrigerators avoid such complications.

Figure 4:
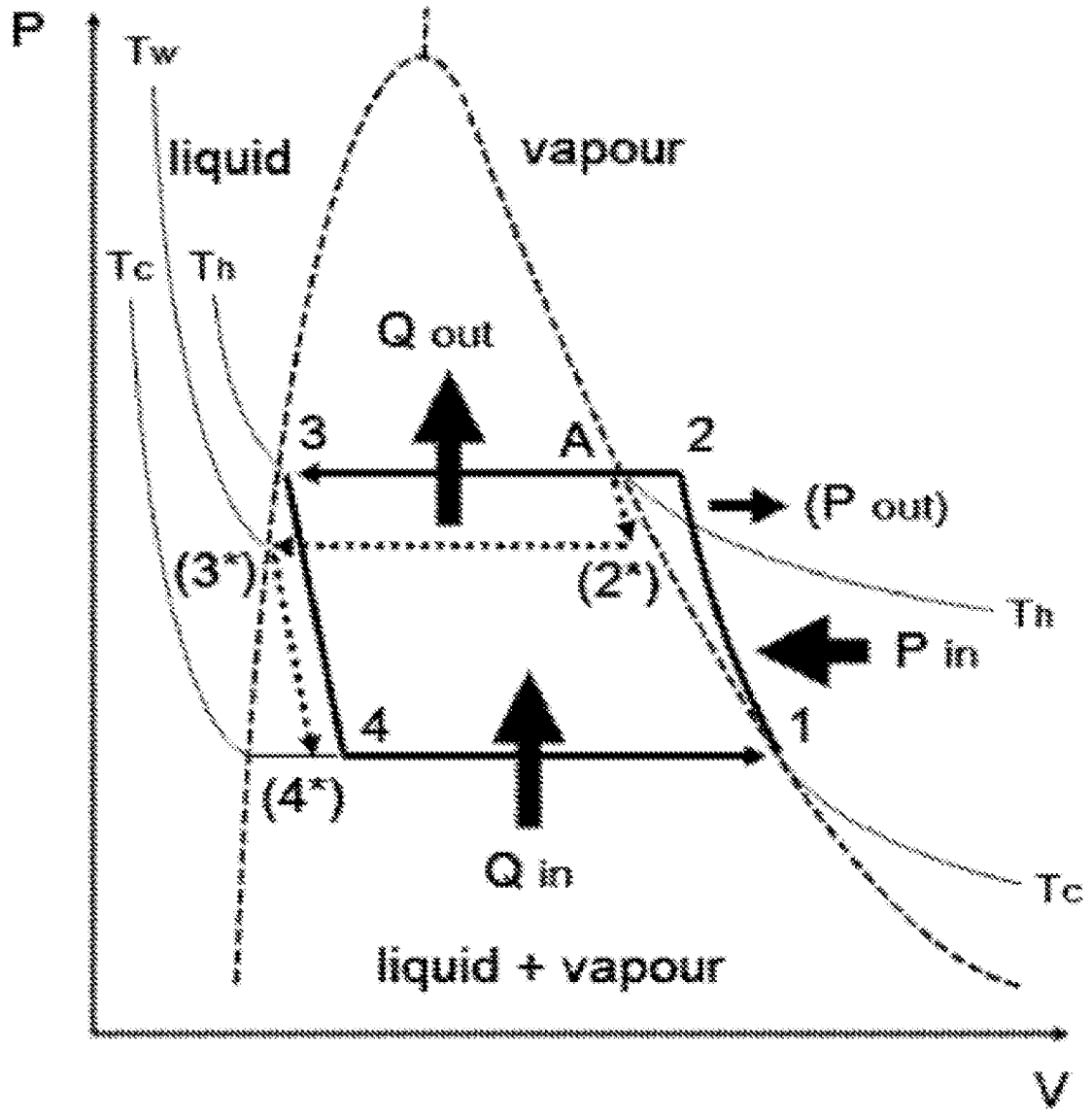
FIG. 4 illustrates a plot of the physics of the conventional vapor compression cycle and a plot of an improved compression cycle, according to an embodiment.

The cycle of FIG. 1 is further explained in FIG. 4, where loop 1-2-A-3-4-1 represents the unmodified cycle and 1-2-A-**2*-3*4*-1** the modified (proposed novel) cycle.

In a conventional refrigeration cycle, heat is transferred from the refrigerant (i.e. the coolant) to the ambient environment surrounding the refrigerator. The heat is transferred from the refrigerant as the refrigerant undergoes a phase change from a gas to a liquid. The heat transferred from the refrigerant may be dissipated away without being used to perform any work. Thus, at least some of the energy put into the refrigerant by the compressor may be wasted as it is lost to the ambient environment. Such heat waste may cause a conventional refrigerator to be inefficient and/or consume more energy than is necessary to cool the refrigerator space.

Implementations of power saving apparatuses for refrigeration as described herein may address some or all of the problems described above. An example power saving apparatus may modify the closed loop vapor circuit compression refrigeration cycle of conventional refrigeration cycles by scavenging the kinetic energy of the hot compressed liquid-vapor with at least one micro-turbine driven permanent-magnet power-generator inserted into said loop between the compressor and the condenser of said circuit. The cycle may repeat indefinitely in closed-loop vapor-pipe-line or one or more refrigeration stages. A refrigeration stage may have some or all of the following devices in the following sequence: a) an electric-motor-driven-compressor, b) a micro-turbine-power-generator, c) a condenser-radiator, d) a throttle and/or e) an evaporator-radiator. The generator may be sealed in said pipe-line and generate low-voltage direct-current, which may be converted to high-voltage alternating-current. Using an inverter, the alternating current may be utilized to offset the power consumption of said refrigerator by feeding the generated power back to the grid which powers said compressor. The refrigerated space comprising the said evaporator may be separated from the rest of said devices and their interconnecting vapor-pipe-lines by heat insulation. The generated low-voltage direct-current electric power converted to said high-voltage alternating current power may be fed back to the grid power by being plugged-in via grid-plug.

As another example, a power saver apparatus that modifies the closed loop vapor circuit compression refrigeration cycle may scavenge the kinetic energy of the hot compressed liquid-vapor with at least one micro-turbine driven permanent-magnet power-generator inserted into said loop between the compressor and the condenser of said circuit. The cycle may repeat indefinitely in closed-loop vapor-pipeline of one or more refrigeration stages. The refrigeration stages may have some or all of the following devices in the following sequence: a) an electric-motor-driven-compressor, b) a selector-bypass-valve c) a micro-turbine-power-generator, d) a condenser-radiator, e) a throttle, and/or f) an evaporator-radiator. The generator may be sealed in said pipe-line and may generate low-voltage direct-current, which may be converted to high-voltage alternating-current. Using an inverter, the high-voltage alternating current may be utilized to offset the power consumption of said refrigerator by feeding the generated power back to the grid which powers said compressor. The valve may be used to bypass said generator when bypassing is selected. The refrigerated space comprising the said evaporator may be separated from the rest of said devices and their interconnecting vapor-pipelines by heat insulation. The inverter may have at least one direct-current power-out-line plugged to a t least one low-voltage socket.

A method of saving power consumption of refrigerators operating by vapor compression in indefinite cycles may include scavenging the kinetic energy of said vapor in its hot phase using a micro-turbine driven power generator and feeding back the generated power to the power source of said refrigerators. Feeding back the power may include alternating current converted from direct current using an inverter. The scavenging may be bypassed using a manual vapor-line valve and/or an electrical-electronic vapor-line servo-valve.

Another example of a power saver apparatus for refrigeration may include a refrigerant gas compressor, a power-generating turbine, an evaporator, an accumulator, a condenser, and/or a fluid-to-gas throttle. The compressor may include a gas inlet and a gas outlet. The turbine may include a gas outlet and a gas inlet directly coupled to the compressor gas outlet. The turbine may generate an electric current in response to a gas spinning a turbine fan of the turbine. The evaporator may include a gas inlet and a gas outlet. The accumulator may include a low-pressure chamber, a high-pressure chamber, a low-pressure gas inlet, a low-pressure gas outlet, a high-pressure gas inlet, and a high-pressure gas outlet. The low-pressure gas inlet may be directly coupled to the evaporator gas outlet and the low-pressure chamber. The low-pressure gas outlet may be directly coupled to the low-pressure chamber and the compressor gas inlet. The high-pressure gas inlet may be directly coupled to the turbine gas outlet and the high-pressure chamber. The high-pressure gas outlet may be coupled to the high-pressure chamber. The high-pressure chamber may be segregated from the low-pressure chamber such that high-pressure refrigerant in the high-pressure chamber is prevented from mixing with low-pressure refrigerant in the low-pressure chamber. The high-pressure chamber and low-pressure chamber may be thermally coupled such that liquid refrigerant in the low-pressure chamber is vaporized by heat exchange with the high-pressure chamber. The condenser may include a gas inlet directly coupled to the high-pressure gas outlet of the accumulator. The condenser may include a fluid outlet. The throttle may include a fluid side directly coupled to the condenser fluid outlet. The throttle may include a gas side directly coupled to the evaporator gas inlet.

The power saver apparatuses may increase the efficiency of a refrigeration cycle by reducing waste heat and/or reducing overall power consumption. For example, heat that may otherwise be wasted by being expelled to the ambient environment surrounding the condenser may be used to vaporize liquid refrigerant before the refrigerant is returned to the compressor. Whereas a conventional refrigeration cycle may include an electric heating element to vaporize liquid refrigerant, implementations according to the present disclosure may utilize heat expelled as the gaseous refrigerant is condensed to a liquid to vaporize liquid refrigerant returning to the compressor. This may reduce the electric power consumption of the refrigeration cycle. Furthermore, the heat transfer in the accumulator may cause a pressure drop across the turbine, which may cause the turbine to spin and generate an electric current. The electric current may be used to power electronic components of the refrigerator or may be fed back into the community grid, thereby again reducing the overall power consumption of the refrigerator.

Figure 2:
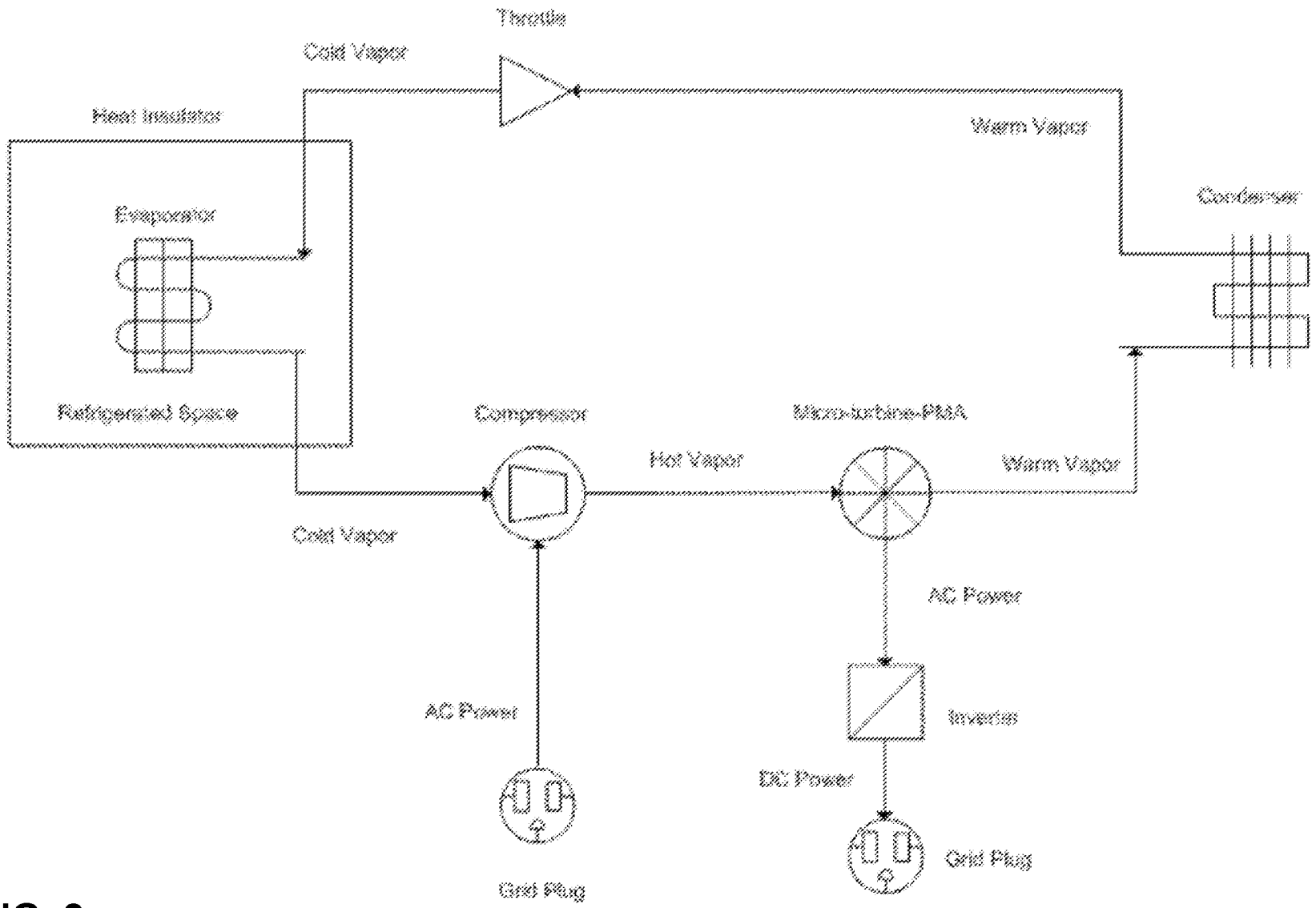
FIG. 2 illustrates an improved compression cycle refrigeration system, according to an embodiment.

Attention is now turned to FIG. 2, which is a diagram illustrating an improved single-stage vapor compression cycle refrigeration system modified as disclosed herein, with components and flow attributes labeled as above.

Shortly after the Compressor, Micro-turbine-PMA may be inserted into the hot vapor half loop. The temperature and pressure may drop on the turbine, which drives a permanent magnet alternator (PMA) or power generator (PMG). The generated DC may be passed through the Inverter and the generated electrical power may be returned as AC to the grid via another Grid Plug. The rest of the process may remain intact. Should the Micro-turbine-PMA be needed to be bypassed temporarily, further adjustment as illustrated next may be implemented.

Figure 3:
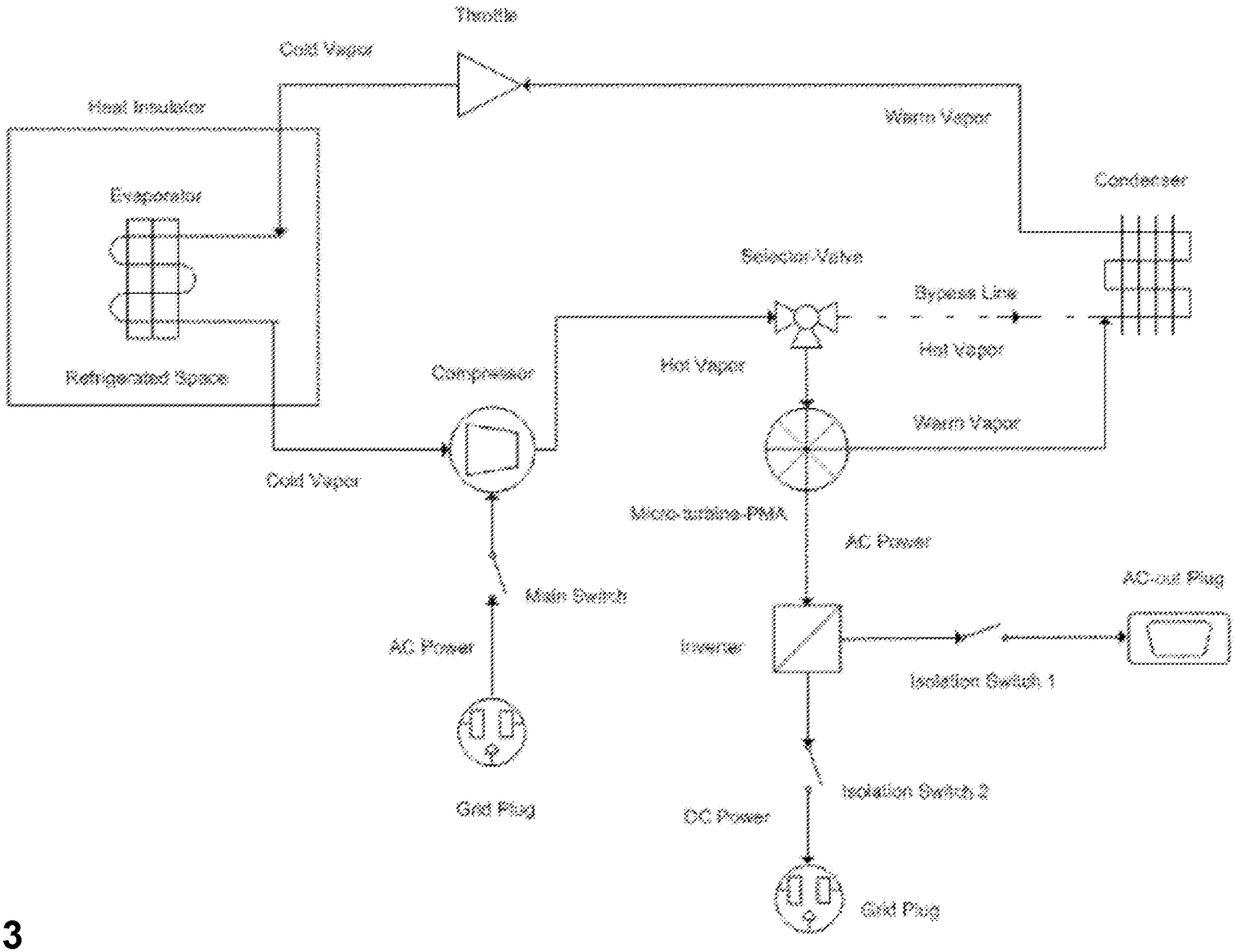
FIG. 3 illustrates another improved compression cycle refrigeration system, according to an embodiment.

Attention is now turned to FIG. 3, which is a diagram illustrating a further improved single stage vapor compression cycle refrigeration system modified as disclosed herein, with components and flow attributes labeled likewise before.

In this example, the Selector-Valve directs the vapor either to the Micro-turbine-PMA via the direct line (full line) or to the Condenser via the bypass line (dashed). The generated AC power now may be diverted from the Inverter via Isolation Switch 2 to the AC-out Plug. Alternatively, the DC power via Isolation Switch 1 may be passed to the Grid Plug as described above. The condenser thus may get either hot (e.g. 90° C.) or warm (e.g. 45° C.) vapor, or vapor in a range between hot and warm. The Selector Valve may be operated manually. The selector valve may be operated electronically by a controlled electrical actuator coil. The generated AC power may be directed to the compressor instead of the grid plug.

Attention is now turned to FIG. 4, which is a Cartesian Pressure-Volume (P-V) plot, which illustrates the physics of a conventional vapor compression cycle (1-2-3-A-4-1 in thick heavy full line) and the modified novel vapor compression refrigeration cycle (**1-2-A-2*-3*-4*-1** in thick heavy full and dotted lines).

The conventional cycle may work as follows: The liquid-vapor phase is within the hot shape dashed line boundary. The cycle starts at point 1. Branch 1-2 is the compression phase, which elevates the vapor pressure and temperature from $T_c$ cold to $T_h$ hot temperatures in the vapor phase by the addition of $P_{in}$ input power of the electricity driving the Compressor. At constant pressure and temperature, the vapor first goes to liquid-vapor at point A, then up to point 3, to the boundary of the phase states. This happens in the Condenser at $T_h$ temperature, while $Q_{out}$ heat, as heat output, is rejected to the environment (branch 2-3) outside of the heat insulated refrigerated closed space. In the Throttle, the liquid-vapor suddenly drops temperature, down to $T_c$ cold and loses pressure (phase change 3-4). n the 4-1 closing Branch, in the Evaporator, the liquid-vapor expands at constant pressure, reaching the vapor phase boundary at point 1. In this Branch, the heat $Q_{in}$, as heat input, of the food in the insulated refrigerated closed space is absorbed. The process may repeat indefinitely, e.g. until an outside influence stops the process.

The modified novel cycle may work as follows: Up to point A, the same. At point A, which is at the phase state boundary, the liquid-vapor drops pressure and temperature to $T_w$ warm (branch A-2*) while DC power $P_{out}$, as output power is scavenged. The rest of the process (2*-3*-4*-1) is similar to process 2-3-4-1. The process modification is indicated by labels in parenthesis. The process may repeat indefinitely.

Thermodynamics assures that the input and output heats are the same ($Q_{in}$=$Q_{out}$) and the difference between the two process-loop areas is equal the output power ($P_{out}$), while the modified process is somewhat slower than the conventional. The refrigerated space may be heat insulated and its doors may be closed at all times, except for food and beverage loading-and-unloading. Otherwise, the refrigerator may consume power indefinitely without significantly cooling the food-and-beverage. The added power-saver must scavenge only a limited portion of the power needed for vapor compression. The food and beverage to be refrigerated is merely described as an example; the refrigeration systems described herein may be used in commercial refrigeration, industrial refrigeration, food processing refrigeration, refrigeration of goods in transport, cooling for electronics, medical refrigeration, cryogenic refrigeration, and so forth.

Refrigerating power may be saved in proportion to $V_{2\text{-}A}/V_{2\text{-}3}$, where $V_{2\text{-}A}$ and $V_{2\text{-}3}$ correspond to the vapor volumes of state transitions 2-A and 2-3 correspondingly. Observing FIG. 4, one may conclude that compressors working at higher pressure are more candidates for power saving by this novel method.

The proposed power saver device may improve refrigeration economy without adding much complexity and price and may be added to any refrigeration system as an after-market device or be integrated into the original refrigerator built for domestic or industrial use. The generated power may be used within the refrigerator, for instance to drive a fan blowing ambient air to the condenser or to power the refrigerator's low voltage controls and door opening-closing actuators to eliminate their inverter.

The present invention is described above with reference to one example embodiment. However, those skilled in the art will recognize that changes and modifications may be made in the described embodiment without departing from the nature and scope of the present invention. For instance, adding thermocouples for supplemental DC power generation by bridging the hot and cold side, or using other than turbine kinetic impeller, or using multiple gate valves or servo-valves instead of a selector-valve, or generating AC, or multi-staging are considered being within the scope of the present disclosure.

Figure 5A:
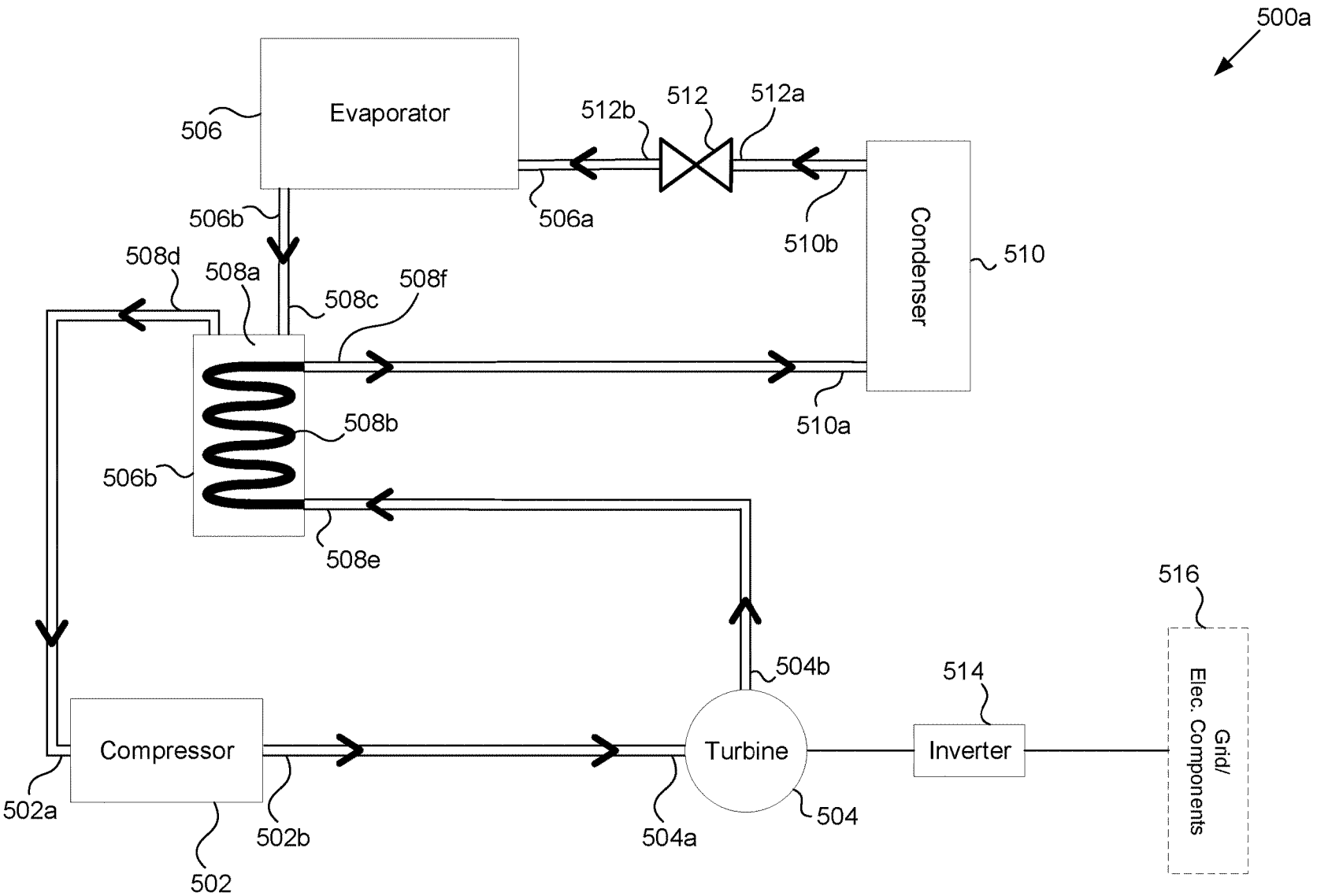
FIG. 5A illustrates a refrigeration system where latent heat from condensing vaporized refrigerant is used to vaporize liquid refrigerant returning to a compressor, according to an embodiment.

FIG. 5A illustrates a refrigeration system 500*a* where latent heat from condensing vaporized refrigerant is used to vaporize liquid refrigerant returning to the compressor 502, according to an embodiment. In the refrigeration system 500*a*, heat that would otherwise be lost to the ambient environment surrounding the refrigerator may be repurposed to prevent liquid refrigerant from reaching the compressor, power electrical and/or electronic components of the refrigerator, or reduce the net power consumption of the refrigerator. This makes the refrigerator more efficient and therefore less costly to operate than a system without the components described below. Additionally, it reduces the heat expelled from the refrigerator to the ambient environment around the refrigerator, thereby reducing the cooling cost of the refrigerator's ambient environment.

The system 500*a* may include refrigerant gas compressor 502. The compressor 502 may include a compressor gas inlet 502*a* and a compressor gas outlet 502*b*. the compressor 502 may include an electric motor or a fuel-powered motor such as a gas motor. The compressor 502 may be a reciprocating compressor, a rotary compressor, a screw compressor, and/or a centrifugal compressor. The compressor may have a compression rating in a range from about 0.5 cubic feet per minute (i.e. CFM) to about 20 CFM depending on the implementation. For example, the compressor 502 may have a rating in a range from about 0.7 CFM to about 1.0 CFM for an in-home food refrigerator, whereas the compressor 502 of a commercial refrigerator may have a rating in a range from 10 CFM to 15 CFM.

The system 500*a* may include a power-generating turbine 504 that generates an electric current in response to a gas spinning a turbine fan of the turbine 504. The power-generating turbine 504 may include a turbine gas inlet 504*a* and a turbine gas outlet 504*b*. The turbine gas inlet 504*a* may be directly coupled to the compressor gas outlet 502*b*. The turbine 504 may be rated for a maximum power output that is similar to the power rating of the compressor 502. The maximum power output of the turbine 504 may be selected as a percentage of the power rating of the compressor 502. For example, the compressor 502 may have a power rating of approximately 300 watts. The maximum power output of the turbine 504 may be selected to 90% the maximum power output of the compressor 502, 80% the maximum power output of the compressor 502, 70% the maximum power output of the compressor 502, 60% the maximum power output of the compressor 502, and so forth. The maximum power output of the turbine 504 may be selected to have a maximum power output approximately equal to or slightly above a power requirement of other electric and/or electronic components of the refrigerator. For example, the turbine 504 may power a 4.5-watt (i.e. W) light-emitting diode (LED) bulb. The turbine 504 may have a maximum power output of 5 W.

The system 500*a* may include an evaporator 506. The evaporator 506 may include an evaporator gas inlet 506*a* and an evaporator gas outlet 506*b*. The evaporator may include a snaked or coiled tube with segments of the tube interconnected by cooling vanes. The evaporator 506 may have a cooling capacity, which is selected based on the implementation of the refrigeration system 500*a*.

The system 500*a* may include an accumulator 508. The accumulator 508 may include a low-pressure chamber 508*a* and a high-pressure chamber 508*b*. The low-pressure chamber 508*a* may have a low-pressure gas inlet 508*c* and a low-pressure gas outlet 508*d*. The low-pressure gas inlet 508*c* may be directly coupled to the low-pressure chamber 508*a* and the evaporator gas outlet 506*b*. The low-pressure gas outlet 508*d* may be directly coupled to the low-pressure chamber 508*a* and the compressor gas inlet 502*a*. The high-pressure chamber 508*b* may have a high-pressure gas inlet 508*e* and a high-pressure gas outlet 508*f*. The high-pressure gas inlet 508*e* may be directly coupled to the turbine gas outlet 504*b* and the high-pressure chamber 508*b*. The high-pressure gas outlet 508*f* may be directly coupled to the high-pressure chamber 508*b*.

The high-pressure chamber 508*b* may be positioned in the accumulator 508 adjacent to the low-pressure chamber 508*a*. The high-pressure chamber 508*b* may be segregated from the low-pressure chamber 508*a* such that high-pressure refrigerant in the high-pressure chamber 508*b* is prevented from mixing with low-pressure refrigerant in the low-pressure chamber 508*a*. The high-pressure chamber 508*b* and the low-pressure chamber 508*a* may be thermally coupled such that liquid refrigerant in the low-pressure chamber 508*a* is vaporized by heat exchange with the high-pressure chamber 508*b*. Thus, liquid refrigerant may be prevented from reaching the compressor 502. Liquid refrigerant may damage the compressor 502 because liquids are generally incompressible. Such damage may reduce the efficiency and/or lifetime of the compressor 502. Transferring heat from the refrigerant leaving the compressor to refrigerant entering the compressor may also improve the efficiency of a condenser 510 downline from the turbine 504 and the compressor 502.

The heat exchange from the high-pressure chamber 508*b* to the liquid refrigerant may create a pressure differential across the turbine 504 such that gaseous refrigerant at the turbine gas inlet 504*a* is at a higher pressure than gaseous refrigerant in the high-pressure chamber 508*b* of the accumulator 508. The high-pressure chamber 508*b* may be a coiled tube disposed within the low-pressure chamber 508*a*. A first wall that at least partially encloses the high-pressure chamber 508*b* may touch a second wall that at least partially encloses the low-pressure chamber 508*a*. The high-pressure chamber 508*b* and the low-pressure chamber 508*a* may share a wall that encloses at least a portion of the high-pressure chamber 508*b* and at least a portion of the low-pressure chamber 508*a*. The low-pressure chamber 508*a* may be disposed within the high-pressure chamber 508*b*. For example, the low-pressure chamber 508*a* may be a coil within a volume of the high-pressure chamber 508*b*. In various implementations of the accumulator 508 and/or the system 500*a*, the low-pressure chamber 508*a* may surround the high-pressure chamber 508*b*, may be adjacent to the high-pressure chamber 508*b*, and/or may be within the high-pressure chamber 508*b*. Various arrangements of the low-pressure chamber 508*a* and the high-pressure chamber 508*b* may enable heat transfer between the chambers sufficient to vaporize liquid refrigerant in the low-pressure chamber 508*a*.

As an example, the low-pressure chamber 508*a* may include a side wall, a top wall, and a bottom wall. The side wall may extend between the top wall and the bottom wall approximately linearly or approximately curvilinearly. The high-pressure chamber 508*b* may be a coiled tube disposed within a volume formed by the side wall, the top wall, and the bottom wall of the low-pressure chamber 508*a*. As another example, a volume formed by the low-pressure chamber 508*a* may encompass the high-pressure chamber 508*b* within the accumulator 508. The low-pressure gas inlet 508*c* of the accumulator 508 may direct refrigerant into the volume of the low-pressure chamber 508*a* and towards a wall of the high-pressure chamber 508*b*. The refrigerant may contact the wall of the high-pressure chamber 508*b*. Heat exchange from the high-pressure chamber 508*b* to the liquid refrigerant in the low-pressure chamber 508*a* may cause a pressure drop in the high-pressure chamber 508*b*. The pressure drop may in turn create a pressure differential across the turbine 504, where a pressure on the inlet side of the turbine 504 is greater than a pressure on the outlet side of the turbine 504. The pressure differential may cause refrigerant to flow through the turbine 504, spinning the fan blades of the turbine 504 and generating an electrical current by the turbine 504.

As another example of the accumulator 508, a portion of the high-pressure chamber 508*b* that is disposed within the accumulator 508 may be encompassed by a volume formed by the low-pressure chamber 508*a*. Additionally or alternatively, a portion of the low-pressure chamber 508*a* disposed within the accumulator 508 may be encompassed by a volume formed by the high-pressure chamber 508*b*. The high-pressure chamber 508*b* may be a coil disposed within a volume formed by the low-pressure chamber 508*a*. The high-pressure chamber 508*b* may have a number of loops in a range from: one loop to ten loops; two loops to five loops; or three loops to four loops. The low-pressure chamber 508*a* may be a coil disposed within a volume formed by the high-pressure chamber 508*b*. The low-pressure chamber 508*a* may have a number of loops in a range from: one loop to ten loops; two loops to five loops; or three loops to four loops.

The system 500*a* may include the condenser 510. The condenser 510 may include a condenser gas inlet 510*a* and a condenser fluid outlet 510*b*. The condenser gas inlet 510*a* may be directly coupled to the high-pressure gas outlet 508*f* of the accumulator 508. The condenser 510 may dissipate heat from the refrigerant to facilitate a state change of the refrigerant from gas to liquid and/or a gas-liquid mixture. The system 500*a* may include a fluid-to-gas throttle 512. The throttle 512 may include a fluid side 512*a* and a gas side 512*b*. The fluid side 512*a* may be directly coupled to the condenser fluid outlet 510*b*. The gas side 512*b* may be directly coupled to the evaporator gas inlet 506*a*.

The system 500*a* may include an inverter 514. The inverter 514 may switch the type of current produced by the turbine 504. For example, when the turbine produces AC current, the inverter 514 may convert the AC current to DC current. When the turbine produces DC current, the inverter 514 may convert the DC current to AC current. The inverter 514 may direct the converted current to a community electrical grid 516 (e.g. in an implementation where the inverter 514 converts low-voltage, high-current DC to high-voltage, low-current AC). The inverter 514 may direct to converted current to an electronic component 516 coupled to the turbine 594 and powered by the electrical current generated by the turbine 504. The electronic component 516 may include: a fan that blows ambient air across the condenser; an interior light or an exterior light of a refrigerator; a control panel of the refrigerator; a door switch of the refrigerator; a door actuator of the refrigerator; and so forth. The turbine 504 may generate DC current and may be used to power one or more DC electronic components 516. The inverter 514 may be bypassed. Similarly, the turbine 504 may generate AC current which may be fed back into the community grid 516. The inverter 514 may be bypassed. A transformer may be placed between the turbine 504 and the grid 516 (e.g. instead of or in addition to the inverter 514) to match the current and voltage output by the turbine to the current and voltage of the grid 516.

Figure 5B:
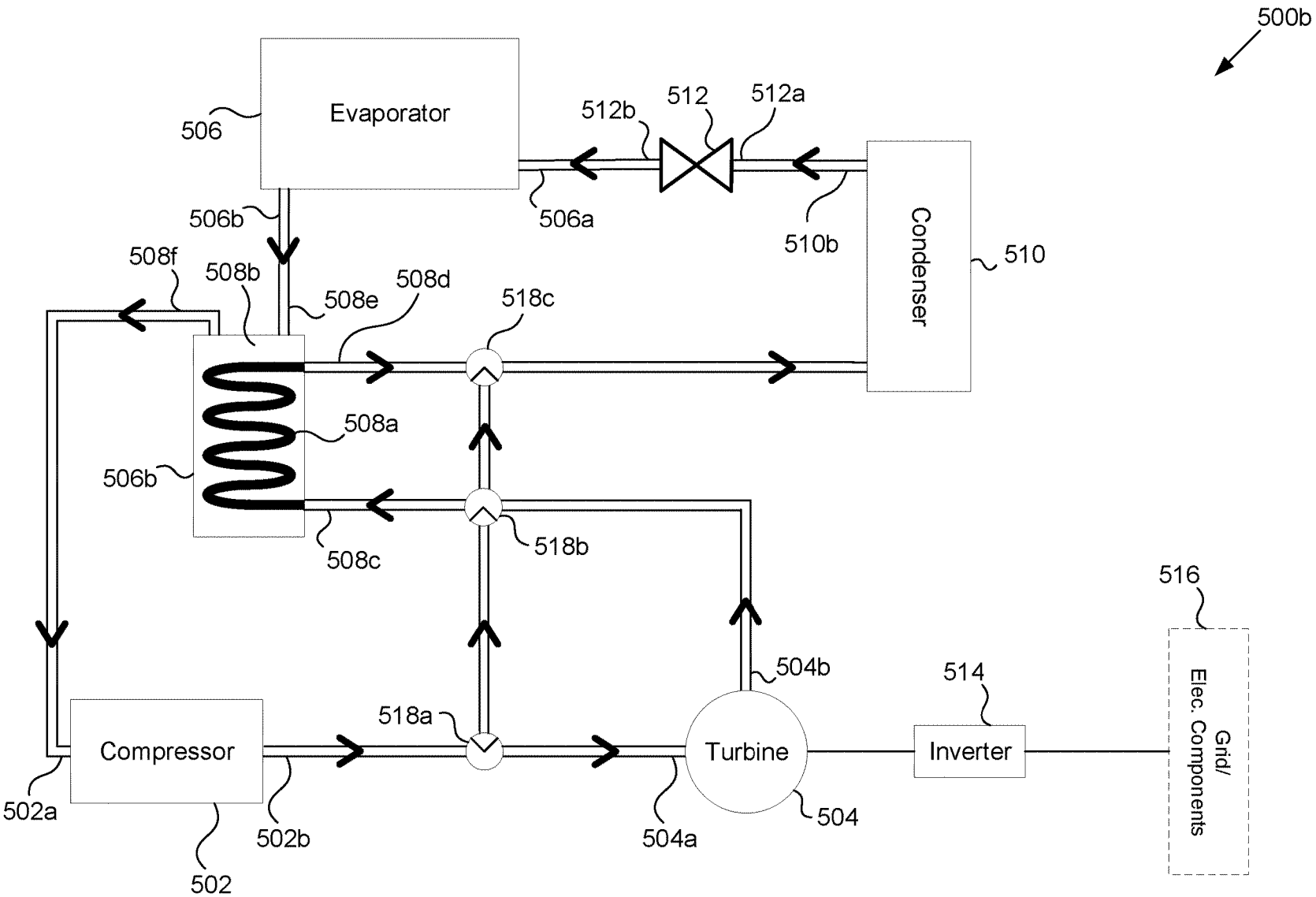
FIG. 5B illustrates a refrigeration system that includes selector valves for bypassing one or more components of the system, according to an embodiment.

FIG. 5B illustrates a refrigeration system 500*b* that includes selector valves 518*a, b*, and c for bypassing one or more components of the system 500*b*, according to an embodiment. The selector valves 518*a, b*, and/or c may enable a user to redirect refrigerant to select how much power is output by the turbine 504, to shut off the turbine 504, and/or to direct refrigerant away from the high-pressure chamber 508*b* of the accumulator 508. The selector valves 518*a, b*, and/or c may enable fine-tuning of the output of the turbine 504 and the heat loss from the condenser 510.

The system 500*b* may include the compressor 502, the turbine 504, the evaporator 506, the accumulator 508, the condenser 510, the throttle 512, the inverter 514, and/or the grid/electronic components 516. The accumulator 508 may include the high-pressure chamber 508*b* and the low-pressure chamber 508*a*. The high-pressure chamber 508*b* may be segregated from the low-pressure chamber 508*a* such that high-pressure refrigerant in the high-pressure chamber 508*b* is prevented from mixing with low-pressure refrigerant in the low-pressure chamber 508*a*. The high-pressure chamber 508*b* and the low-pressure chamber 508*a* may be thermally coupled such that liquid refrigerant in the low-pressure chamber 508*a* is vaporized by heat exchange with the high-pressure chamber 508*b*. The turbine 504 may be coupled to the compressor 502 and the high-pressure chamber 508*b* of the accumulator 508. The turbine 504 may be coupled sequentially between the compressor 502 and the accumulator 508. The condenser 510 may be coupled to the high-pressure chamber 508*b* of the accumulator 508 and the throttle 512 sequentially between the accumulator 508 and the throttle 512. The evaporator 506 may be coupled to the throttle 512 and the low-pressure chamber 508*a* of the accumulator 508 sequentially between the throttle 512 and the accumulator 508. The high-pressure chamber 508*b* of the accumulator 508 may be coupled sequentially between the turbine 504 and the condenser 510. The low-pressure chamber 508*a* of the accumulator 508 may be coupled sequentially between the evaporator 506 and the compressor 502.

The selector valve 518*a* may be connected sequentially inline between the compressor 502 and the turbine 504. The selector valves 518*a*, 518*b*, and/or 518*c* may be connected sequentially inline between the compressor 502 and the condenser 510. The selector valves 518*a* and/or 518*b* may be connected sequentially inline between the compressor 502 and accumulator 508. One or more of the selector valves 518*a*, 518*b*, and 518*c* may be removed (i.e. may be excluded when the system 500*b* is constructed) and the system 500*b* may operate without the removed selector valve.

Figure 6:
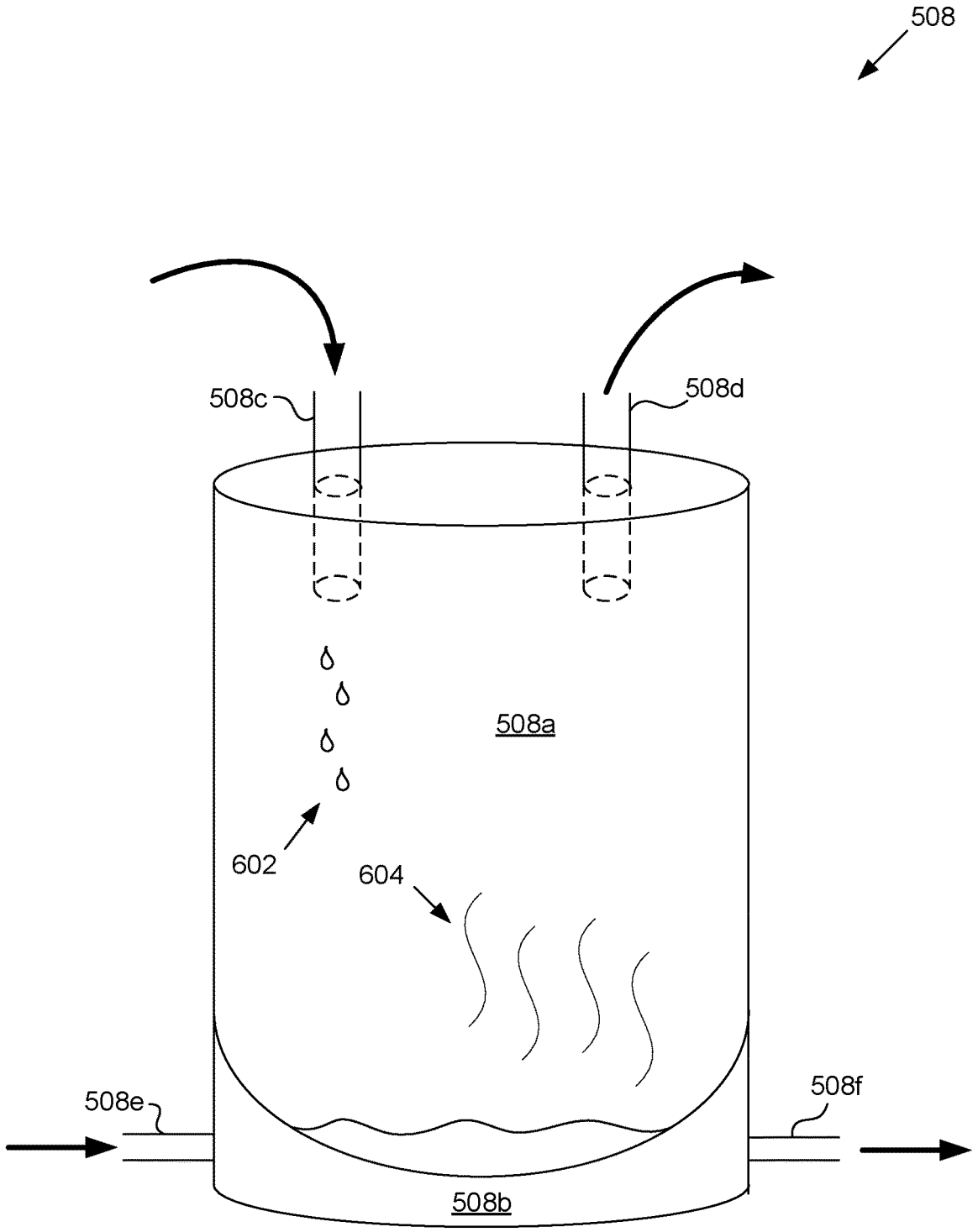
FIG. 6 illustrates an example of an accumulator with a high-pressure chamber positioned below and adjacent to a low-pressure chamber, according to an embodiment.

FIG. 6 illustrates an example of the accumulator 508 with the high-pressure chamber 508*b* positioned below and adjacent to the low-pressure chamber 508*a*, according to an embodiment. Aligning the low-pressure chamber 508*a* vertically over the high-pressure chamber 508*b* may enable separation of liquid refrigerant 602 from gaseous refrigerant 604. The liquid refrigerant 602, being heavier, may fall due to gravity on the floor of the low-pressure chamber 508*a* adjacent to the high-pressure chamber 508*b*. Gaseous refrigerant 604 may rise above the liquid refrigerant 602 and flow out of the accumulator 508 to the compressor 502. Thus, the liquid refrigerant 602 may be prevented from reaching the compressor 502.

The accumulator 508 may be vertically oriented such that the low-pressure chamber 508*a* is positioned above the high-pressure chamber 508*b*. The low-pressure inlet 508*c* and the low-pressure outlet 508*d* may be disposed at a top portion and/or on a top wall of the accumulator 508 and the low-pressure chamber 508*a*. The high-pressure chamber 508*b* may be directly below the low-pressure chamber 508*a*. The high-pressure inlet 508*e* and the high-pressure outlet 508*f* may be positioned near or on a bottom surface of the accumulator 508. The high-pressure chamber 508*b* may be a coil that is stacked, nested, and/or concentric. A wall of the high-pressure chamber 508*b* may form the floor of the low-pressure chamber 508*a*. The liquid refrigerant 602 may accumulate, due to gravity, at the bottom of the low-pressure chamber 508*a* adjacent to the wall that separates the low-pressure chamber 508*a* from the high-pressure chamber 508*b*. Heat may be transferred from the high-pressure chamber 508*b* to the liquid refrigerant 602, vaporizing the liquid refrigerant 602. Gaseous refrigerant 604 may rise above the liquid refrigerant 602 and exit the accumulator through the low-pressure outlet 508*d*.

Figure 7A:
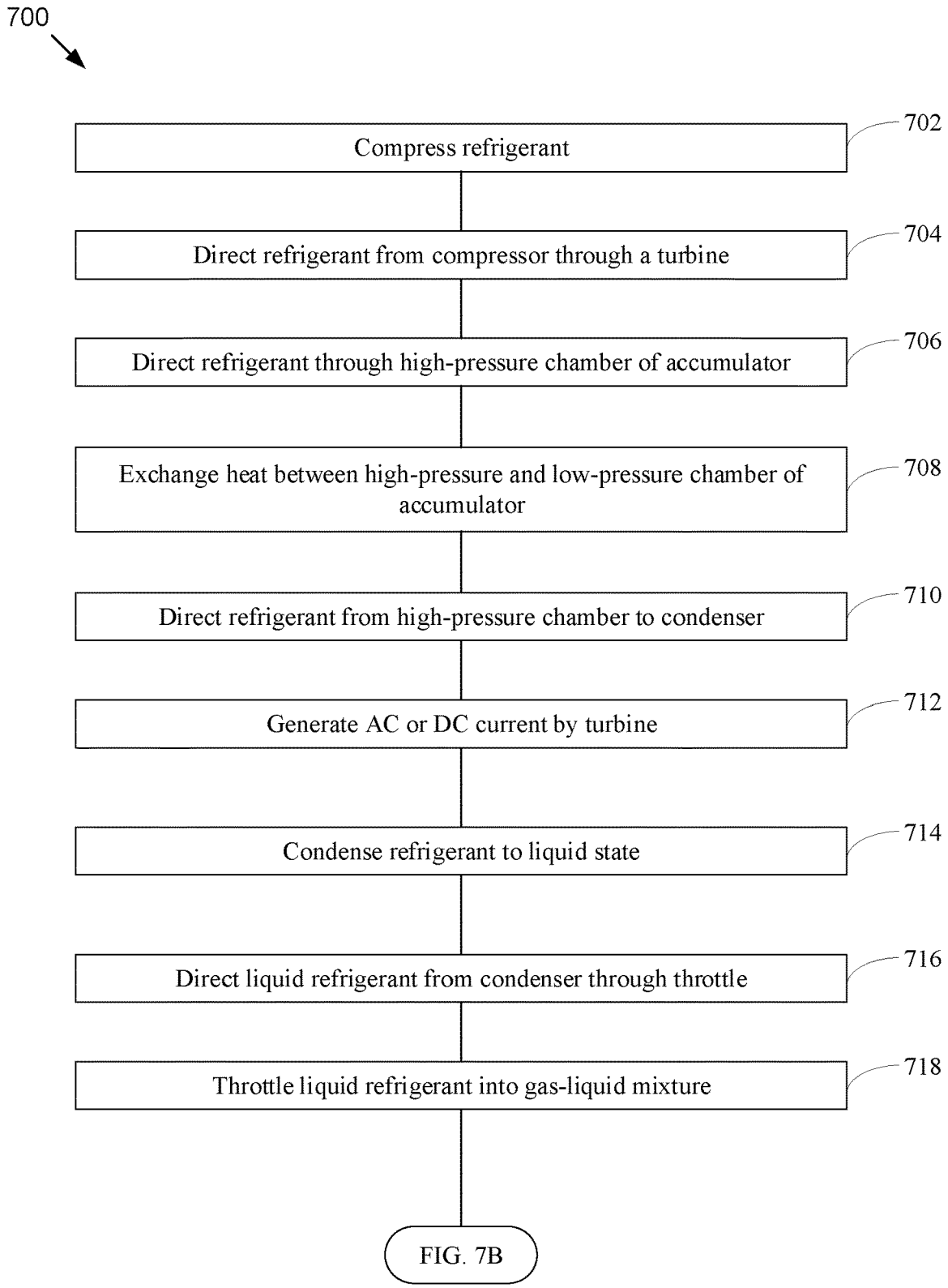
FIG. 7A illustrates a method of repurposing waste heat in a refrigeration cycle, according to an embodiment.

FIG. 7A illustrates a method 700 of repurposing waste heat in a refrigeration cycle, according to an embodiment. Repurposing waste heat may increase the efficiency of the system and/or reduce heat expenditure to the ambient environment around the refrigerator. Reducing waste heat may also result in less energy consumption by the system. Waste heat that may otherwise dissipate into the ambient environment may be used to prevent liquid refrigerant from reaching the compressor, may be used to power electric and/or electronic components of the system. Waste heat may be converted to electricity that may be fed back into the community electrical grid. Waste heat may be converted to electricity and stored in a battery.

The method 700 may include compressing, at a compressor (e.g. the compressor 502), a gaseous refrigerant from having a first pressure in a first range to a second pressure in a second range (block 702). The first pressure may be less than the second pressure. The pressures may depend on various features of the refrigerant such as the vapor-point of the refrigerant, the pressure limits of the components of the system, the condensing capacity of the condenser, the cooling capacity of the evaporator, and so forth. The method 700 may include directing the gaseous refrigerant from the compressor through a turbine (e.g. the turbine 504) (block 704). As the gas passes through the turbine, the gas may impinge on a fan blade that is coupled to a rotor and permanent magnet. The pressure of the gas on the fan blade may cause the rotor and permanent magnet to rotate, which may generate a current.

The method 700 may include directing the gaseous refrigerant from the turbine through a high-pressure chamber of an accumulator (e.g. the high-pressure chamber 508*b* of the accumulator 508) (block 706). The accumulator may prevent liquid refrigerant from reaching the compressor. The accumulator may also separate oil from the refrigerant. The accumulator may include an oil return line that returns oil to the compressor. The method 700 may include exchanging heat from gaseous refrigerant in the high-pressure chamber to a low-pressure chamber of the accumulator (e.g. the low-pressure chamber 508*a* of the accumulator 508) (block 708). The high-pressure chamber may be segregated from the low-pressure chamber. In the high-pressure chamber, and as a result of the heat exchange, the gaseous refrigerant may drop from the second pressure to a third pressure in a third range, where the third pressure is less than the second pressure and greater than the first pressure. The difference between the second pressure and the third pressure may be set by (e.g. may depend on) an external surface area of the high-pressure chamber that is disposed within the low-pressure chamber. The difference between the second pressure and the third pressure may depend on an amount of liquid refrigerant in the low-pressure chamber that is vaporized by contact and/or proximity with the high-pressure chamber.

The method 700 may include directing the gaseous refrigerant from the high-pressure chamber of the accumulator through a condenser (i.e. the condenser 510) (block 710). The condenser may expose the refrigerant to a surface area that is exposed to the ambient environment of the refrigerator. The surface area may be large relative to the volume of the refrigerant. The condenser may thereby facilitate heat transfer from the refrigerant to the ambient environment. The heat transfer may be sufficient to cause a state change of the refrigerant.

The method 700 may include, in response to the gaseous refrigerant being directed through the turbine and/or the pressure dropping across the turbine, generating a direct current or an alternating current by the turbine (block 712). The method 700 may include condensing, by the condenser, the gaseous refrigerant to a liquid refrigerant (block 714). The method 700 may include directing the liquid refrigerant from the condenser through a throttle (e.g. the throttle 512) (block 716). The method 700 may include throttling, by the throttle, the liquid refrigerant (block 718). The liquid refrigerant may undergo adiabatic expansion as the liquid refrigerant passes through the throttle. The liquid refrigerant may become a gas or a gas-liquid mixture of the gaseous refrigerant and the liquid refrigerant as the liquid refrigerant is expelled from the throttle. The adiabatic expansion of the refrigerant may drastically cool the refrigerant to a temperature below the first temperature (i.e. the temperature of the refrigerant as it enters the compressor), the second temperature (i.e. the temperature of the refrigerant as it leaves the compressor), or the third temperature (i.e. the temperature of the refrigerant as it leaves the high-pressure chamber of the accumulator).

Figure 7B:
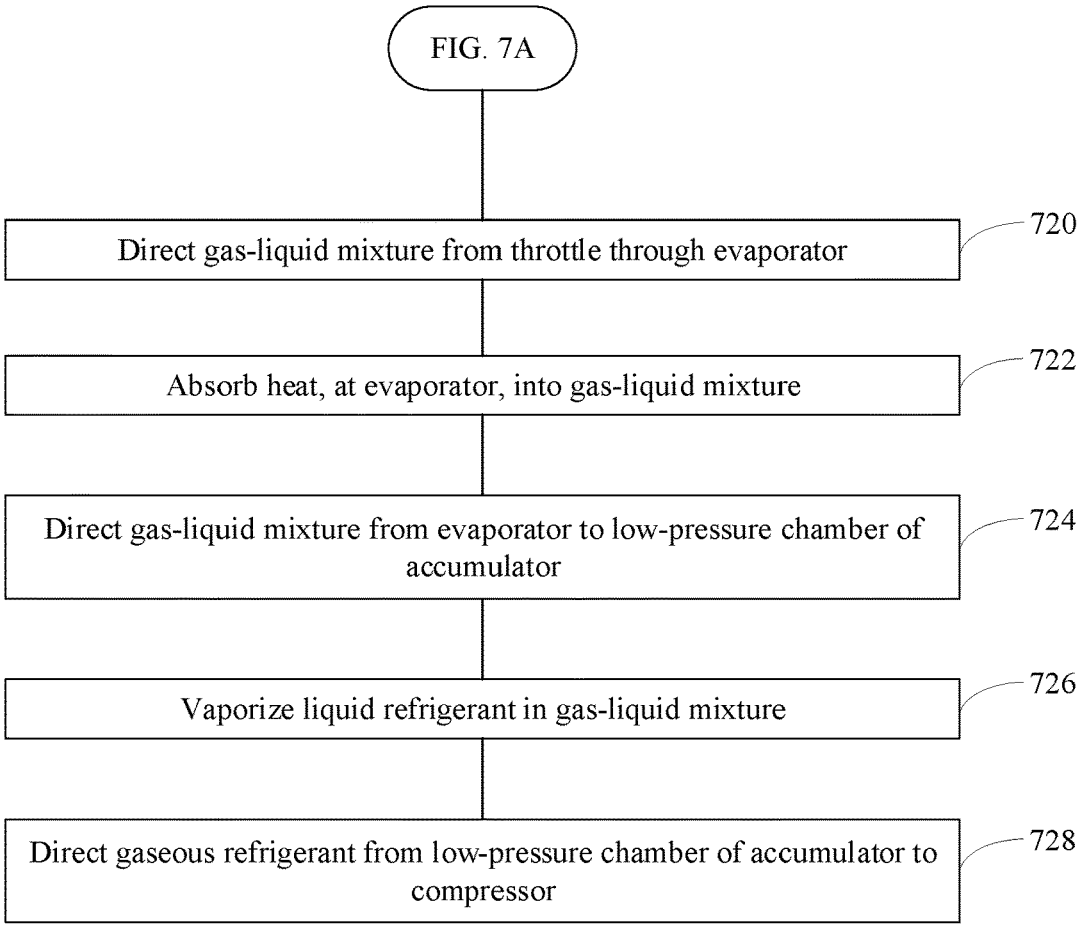
FIG. 7B illustrates a continuation of the method illustrated in FIG. 7A, according to an embodiment.

FIG. 7B illustrates a continuation of the method 700, according to an embodiment. The method 700 may include directing the gas-liquid mixture from the throttle through an evaporator (e.g. the evaporator 506) (block 720). The method 700 may include absorbing heat, at the evaporator, into the gas-liquid mixture (block 722). The method 700 may include directing the gas-liquid mixture from the evaporator to the low-pressure chamber of the accumulator (block 724). The method 700 may include, in response to heat being exchanged from the gaseous refrigerant in the high-pressure chamber to the low-pressure chamber, vaporizing the liquid refrigerant in the gas-liquid mixture (block 726). The gas-liquid mixture may become gaseous refrigerant. The method 700 may include directing the gaseous refrigerant from the low-pressure chamber of the accumulator to the compressor (block 728).

Figure 8A:
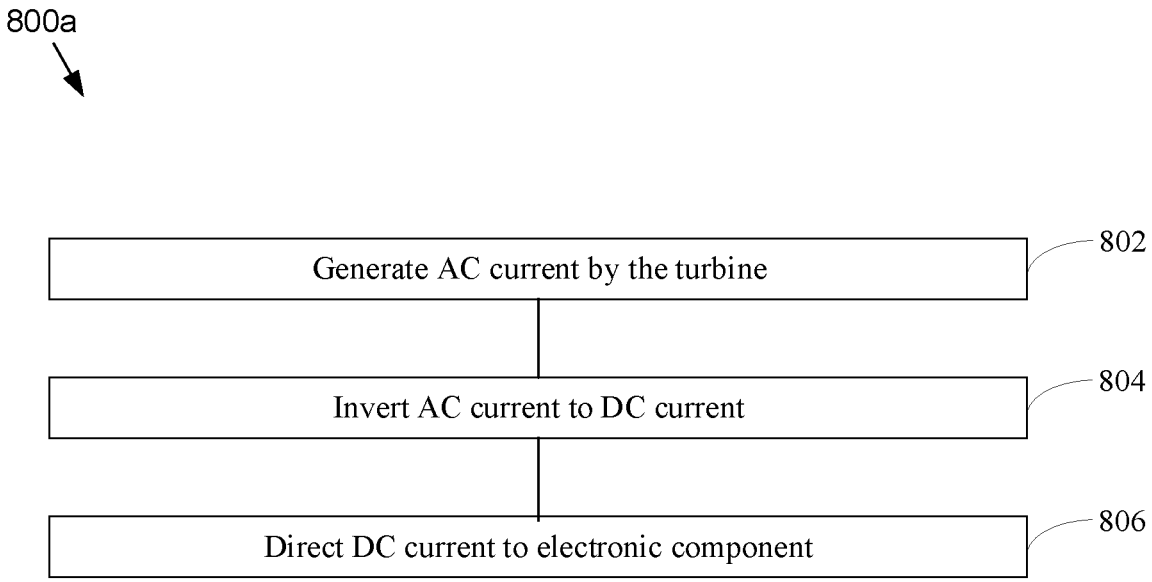
FIG. 8A illustrates a method of using electricity generated by a turbine, according to an embodiment.

FIG. 8A illustrates a method 800*a* of using electricity generated by the turbine, according to an embodiment. Using the various systems and components described herein, waste heat from a refrigeration cycle (e.g. the as described regarding the method 700) may be repurposed. One way the waste heat may be used is to power electronics. The waste heat may be converted to electricity and fed back into a power gird and/or power supply (e.g. a battery). The waste heat may be used to perform various tasks in the system such as preventing liquid refrigerant from reaching the compressor.

The method 800*a* may include generating an AC current by the turbine (block 802). The method 800*a* may include, in response to generating an AC current, inverting the AC current to DC current (block 804). The method 800*a* may include directing the DC current to an electronic component of a refrigerator (block 806). The electronic component may include: a fan; a light; a control panel; a door switch; a door actuator; and so forth. In another example method, the turbine may generate AC current. The inverter may be bypassed, and the AC current may be directed to a circuit that operates on AC current. Such a circuit may include an AC electronic device, a community power grid, and so forth.

Figure 8B:
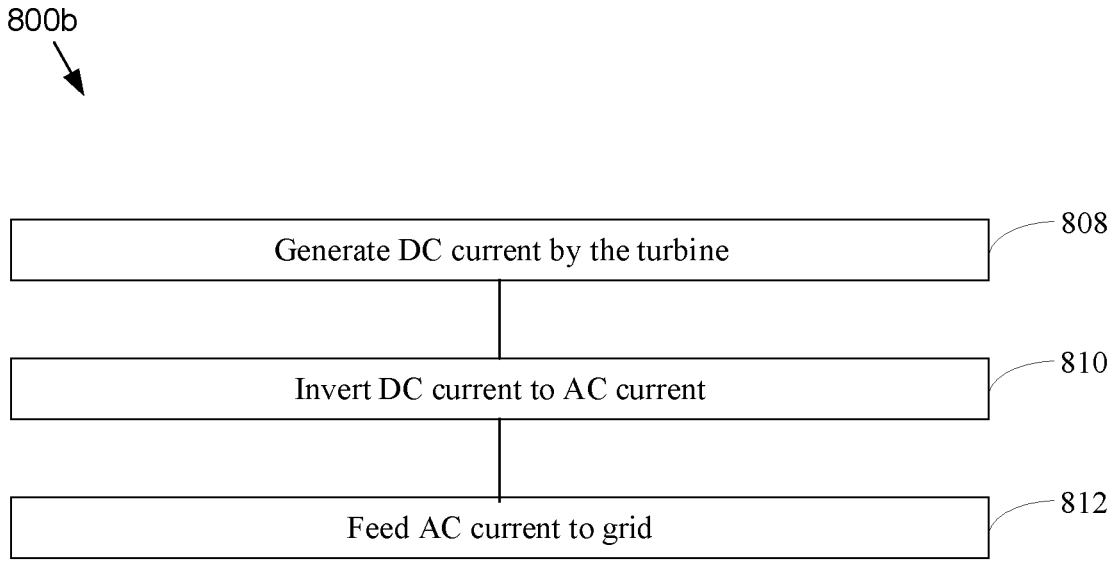
FIG. 8B illustrates another method of using the electricity generated by the turbine, according to an embodiment.

FIG. 8B illustrates another method 800*b* of using the electricity generated by the turbine, according to an embodiment. The electricity may be repurposed waste heat. The electricity may be used to increase the efficiency of the refrigeration system.

The method 800*b* may include generating a DC current (block 808). The method 800*b* may include, in response to generating the DC current, inverting the DC current to AC current (block 810). The method 800*b* may include feeding the alternating current into a community power grid and/or powering an AC electric/electronic device (block 812). In another example method, the turbine may generate DC current. The inverter may be bypassed, and the DC current may be directed to a circuit that operates on DC current. Such a circuit may include an electronic component of the refrigerator.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of methods described herein may be executed in one or more ways such as by a human, by a processing device, by mechanisms operating automatically or under human control, and so forth. Additionally, although various elements of a method may be depicted in the figures in a particular order, the elements of the method may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. And, an example described using a list of alternatively-inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower or equal in scope to the original claims, are to be considered within the subject matter of the examples described herein.

The invention claimed is:

1. A system, comprising:

a refrigerant gas compressor comprising:
- a compressor gas inlet; and
- a compressor gas outlet;

a power-generating turbine that generates an electric current in response to a gas spinning a turbine fan of the turbine, the power-generating turbine comprising:
- a turbine gas inlet directly coupled to the compressor gas outlet; and
- a turbine gas outlet;

an evaporator comprising:
- an evaporator gas inlet; and
- an evaporator gas outlet;

an accumulator comprising:
- a low-pressure chamber;
- a low-pressure gas inlet directly coupled to:
  - the evaporator gas outlet; and
  - the low-pressure chamber;
- a low-pressure gas outlet directly coupled to:
  - the low-pressure chamber; and
  - the compressor gas inlet;
- a high-pressure chamber adjacent to the low-pressure chamber, wherein:
  - the high-pressure chamber is segregated from the low-pressure chamber such that high-pressure refrigerant in the high-pressure chamber is prevented from mixing with low-pressure refrigerant in the low-pressure chamber; and
  - the high-pressure chamber and low-pressure chamber are thermally coupled such that liquid refrigerant in the low-pressure chamber is vaporized by heat exchange with the high-pressure chamber;
  - the heat exchange from the high-pressure chamber to the liquid refrigerant creates a pressure differential across the turbine such that gaseous refrigerant at the turbine gas inlet is at a higher pressure than gaseous refrigerant in the high-pressure chamber of the accumulator
- a high-pressure gas inlet directly coupled to:
  - the turbine gas outlet; and
  - the high-pressure chamber;
- a high-pressure gas outlet directly coupled to the high-pressure chamber;

a condenser comprising:

a condenser gas inlet directly coupled to the high-pressure gas outlet of the accumulator; and a condenser fluid outlet; and a fluid-to-gas throttle comprising:

a fluid side directly coupled to the condenser fluid outlet; and a gas side directly coupled to the evaporator gas inlet.

2. The system of claim 1, further comprising an electronic component coupled to the turbine and powered by an electrical current generated by the turbine, wherein the electronic component comprises:

a fan that blows ambient air across the condenser;

an interior light or an exterior light of a refrigerator;

a control panel of the refrigerator;

a door switch of the refrigerator; or a door actuator of the refrigerator.

3. The system of claim 1, wherein the pressure differential across the turbine causes the turbine to spin and generate an electrical current.

4. The system of claim 1, wherein:

the accumulator is vertically oriented;

the high-pressure chamber is directly below the low-pressure chamber; and the liquid refrigerant accumulates, due to gravity, at a bottom of the low-pressure chamber adjacent to a wall separating the low-pressure chamber from the high-pressure chamber.

5. The system of claim 1, wherein the high-pressure chamber comprises a coiled tube disposed within the low-pressure chamber.

6. The system of claim 1, wherein;

a first wall that at least partially encloses the high-pressure chamber touches a second wall that at least partially encloses the low-pressure chamber; or the high-pressure chamber and the low-pressure chamber share a third wall that encloses at least a portion of the high-pressure chamber and at least a portion of the low-pressure chamber.

7. The system of claim 1, wherein the low-pressure chamber is disposed within the high-pressure chamber.

8. A system, comprising:

a compressor;

an accumulator comprising:

a high-pressure chamber; and a low-pressure chamber, wherein:

the high-pressure chamber is segregated from the low-pressure chamber such that high-pressure refrigerant in the high-pressure chamber is prevented from mixing with low-pressure refrigerant in the low-pressure chamber; and the high-pressure chamber and low-pressure chamber are thermally coupled such that liquid refrigerant in the low-pressure chamber is vaporized by heat exchange with the high-pressure chamber;

a turbine coupled to the compressor and the high-pressure chamber of the accumulator, the turbine coupled sequentially between the compressor and the accumulator;

a throttle;

a condenser coupled to the high-pressure chamber of the accumulator and the throttle, the condenser coupled sequentially between the accumulator and the throttle; and an evaporator coupled to the throttle and the low-pressure chamber of the accumulator, the evaporator coupled sequentially between the throttle and the accumulator, wherein:

the high-pressure chamber of the accumulator is coupled sequentially between the turbine and the condenser; and the low-pressure chamber of the accumulator is coupled sequentially between the evaporator and the compressor.

9. The system of claim 8, further comprising a selector valve connected sequentially inline between:

the compressor and the turbine; and the compressor and the condenser.

10. The system of claim 8, further comprising a selector valve connected sequentially inline between:

the compressor and the turbine; and the compressor and the accumulator.

11. The system of claim 8, further comprising an electronic component electronically coupled to the turbine and at least partially powered by an electrical current generated by the turbine, wherein the electronic component comprises:

a fan;

a light;

a control panel;

a door switch; or a door actuator.

12. The system of claim 8, wherein:

the low-pressure chamber comprises a side wall, a top wall, and a bottom wall;

the side wall extends between the top wall and the bottom wall:

approximately linearly; or curvilinearly; and the high-pressure chamber comprises a coiled tube disposed within a volume formed by the side wall, the top wall, and the bottom wall of the low-pressure chamber.

13. The system of claim 8, wherein:

a volume formed by the low-pressure chamber encompasses the high-pressure chamber within the accumulator; and a low-pressure inlet of the accumulator directs refrigerant into the volume of the low-pressure chamber and towards a wall of the high-pressure chamber.

14. The system of claim 8, wherein the heat exchange from the high-pressure chamber to liquid refrigerant in the low-pressure chamber creates a pressure differential across the turbine.

15. A method, comprising:

compressing, at a compressor, a gaseous refrigerant from having a first pressure in a first range to a second pressure in a second range, wherein the first pressure is less than the second pressure;

directing the gaseous refrigerant from the compressor through a turbine;

in response to the gaseous refrigerant being directed through the turbine, generating a direct current or an alternating current by the turbine;

directing the gaseous refrigerant from the turbine through a high-pressure chamber of an accumulator;

exchanging heat from the gaseous refrigerant in the high-pressure chamber to a low-pressure chamber of the accumulator, wherein:

the high-pressure chamber is segregated from the low-pressure chamber;

the gaseous refrigerant drops from the second pressure to a third pressure in a third range; and the third pressure is less than the second pressure and greater than the first pressure;

directing the gaseous refrigerant from the high-pressure chamber of the accumulator through a condenser;

condensing, by the condenser, the gaseous refrigerant to a liquid refrigerant;

directing the liquid refrigerant from the condenser through a throttle;

throttling, by the throttle, the liquid refrigerant, wherein:

the liquid refrigerant undergoes adiabatic expansion as the liquid refrigerant passes through the throttle; and the liquid refrigerant becomes a gas-liquid mixture of the gaseous refrigerant and the liquid refrigerant as the liquid refrigerant is expelled from the throttle; and directing the gas-liquid mixture from the throttle through an evaporator;

absorbing heat, at the evaporator, into the gas-liquid mixture;

directing the gas-liquid mixture from the evaporator to the low-pressure chamber of the accumulator;

in response to heat being exchanged from the gaseous refrigerant in the high-pressure chamber to the low-pressure chamber, vaporizing the liquid refrigerant in the gas-liquid mixture, wherein the gas-liquid mixture becomes the gaseous refrigerant; and directing the gaseous refrigerant from the low-pressure chamber of the accumulator to the compressor.

16. The method of claim 15, further comprising, in response to generating the direct current:

inverting the direct current to alternating current; and feeding the alternating current into a community power grid.

17. The method of claim 15, further comprising, in response to generating the alternating current:

inverting the alternating current to direct current; and directing the direct current to an electronic component of a refrigerator, the electronic component comprising:

a fan;

a light;

a control panel;

a door switch; or a door actuator.

18. The method of claim 15, wherein:

a portion of the high-pressure chamber disposed within the accumulator is encompassed by a volume formed by the low-pressure chamber; or a portion of the low-pressure chamber disposed within the accumulator is encompassed by a volume formed by the high-pressure chamber.

19. The method of claim 18, wherein when the portion of the high-pressure chamber disposed within the accumulator is encompassed by a volume formed by the low-pressure chamber, the high-pressure chamber comprises a coil having a number of loops in a range from:

one loop to ten loops;

two loops to five loops; or three loops to four loops.

20. The method of claim 15, wherein a difference between the second pressure and the third pressure is set by an external surface area of the high-pressure chamber that is disposed within the low-pressure chamber.

* * * * *